US011318740B2

(12) United States Patent
Hanaoka et al.

(10) Patent No.: US 11,318,740 B2
(45) Date of Patent: May 3, 2022

(54) LIQUID EJECTING SYSTEM

(71) Applicant: SEIKO EPSON CORPORATION, Tokyo (JP)

(72) Inventors: Yukihiro Hanaoka, Shiojiri (JP); Toshiro Murayama, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 36 days.

(21) Appl. No.: 16/882,996

(22) Filed: May 26, 2020

(65) Prior Publication Data

US 2020/0376835 A1 Dec. 3, 2020

(30) Foreign Application Priority Data

May 29, 2019 (JP) ..... JP2019-100421

(51) Int. Cl.
*B41J 2/045* (2006.01)
*B41J 2/195* (2006.01)
*B41J 2/185* (2006.01)

(52) U.S. Cl.
CPC ..... *B41J 2/04581* (2013.01); *B41J 2/185* (2013.01); *B41J 2/195* (2013.01)

(58) Field of Classification Search
CPC .... B41J 2/175; B41J 2/17596; B41J 2202/12; B41J 2/18; B41J 2002/14419; B41J 2/04581; B41J 2/14233; B41J 2/185; B41J 2/195
See application file for complete search history.

(56) References Cited

U.S. PATENT DOCUMENTS

2010/0245495 A1* 9/2010 Katada ..... B41J 2/175 347/85
2013/0293604 A1 11/2013 Nitta et al.

FOREIGN PATENT DOCUMENTS

JP 2013-107403 A 6/2013

* cited by examiner

*Primary Examiner* — Jannelle M Lebron
(74) *Attorney, Agent, or Firm* — Workman Nydegger

(57) ABSTRACT

A liquid ejecting system includes a liquid ejecting head having a nozzle ejecting liquid, a supply channel communicating with the nozzle, and a recovery channel communicated with the nozzle, and circulates the liquid in the liquid ejecting head through the supply channel and the recovery channel. The supply channel includes a pressurizing section and a first buffer mechanism disposed between the nozzle and the pressurizing section. The recovery channel includes a decompression section and a second buffer mechanism disposed between the nozzle and the decompression section. The first buffer mechanism is configured to increase a buffer capacity as the supply channel is pressurized. The second buffer mechanism is configured to reduce a buffer capacity as the recovery channel is decompressed.

7 Claims, 7 Drawing Sheets

LIQUID EJECTING SYSTEM

The present application is based on, and claims priority from JP Application Serial Number 2019-100421, filed May 29, 2019, the disclosure of which is hereby incorporated by reference herein in its entirety.

BACKGROUND

1. Technical Field

The present disclosure relates to a liquid ejecting system which has a liquid ejecting head ejecting liquid, a supply channel, and a recovery channel and which circulates liquid in the liquid ejecting head, and particularly relates to an ink jet recording system ejecting ink as liquid.

2. Related Art

A liquid ejecting system configured to circulate ink in a liquid ejecting head so that bubbles in the ink are discharged, increase in viscosity of the ink is suppressed, and components included in the ink is prevented from being precipitated has been proposed for the liquid ejecting head ejecting liquid (refer to JP-A-2013-107403).

In such a liquid ejecting system, pressure of ink is detected and pressure of a circulating system is controlled by controlling a pump based on a result of the detection.

However, there arises a problem in that, when the pressure of the ink is detected and the pump is controlled based on the result of the detection as disclosed in JP-A-2013-107403, it is difficult to control the pressure of the circulating system in accordance with a change in pressure such as pulsation of a pump.

Note that such a problem is not limited to ink jet recording systems and similarly arises in liquid ejecting systems ejecting liquid other than ink.

SUMMARY

The present disclosure provides a liquid ejecting system capable of performing pressure control in accordance with a change in pressure.

According to an aspect of the present disclosure, a liquid ejecting system includes a liquid ejecting head having a nozzle ejecting liquid, a supply channel communicating with the nozzle, and a recovery channel communicated with the nozzle, and circulates the liquid in the liquid ejecting head through the supply channel and the recovery channel. The supply channel includes a pressurizing section and a first buffer mechanism disposed between the nozzle and the pressurizing section. The recovery channel includes a decompression section and a second buffer mechanism disposed between the nozzle and the decompression section. The first buffer mechanism is configured to increase a buffer capacity as the supply channel is pressurized. The second buffer mechanism is configured to reduce a buffer capacity as the recovery channel is decompressed.

DESCRIPTION OF EXEMPLARY EMBODIMENTS

Figure 1:
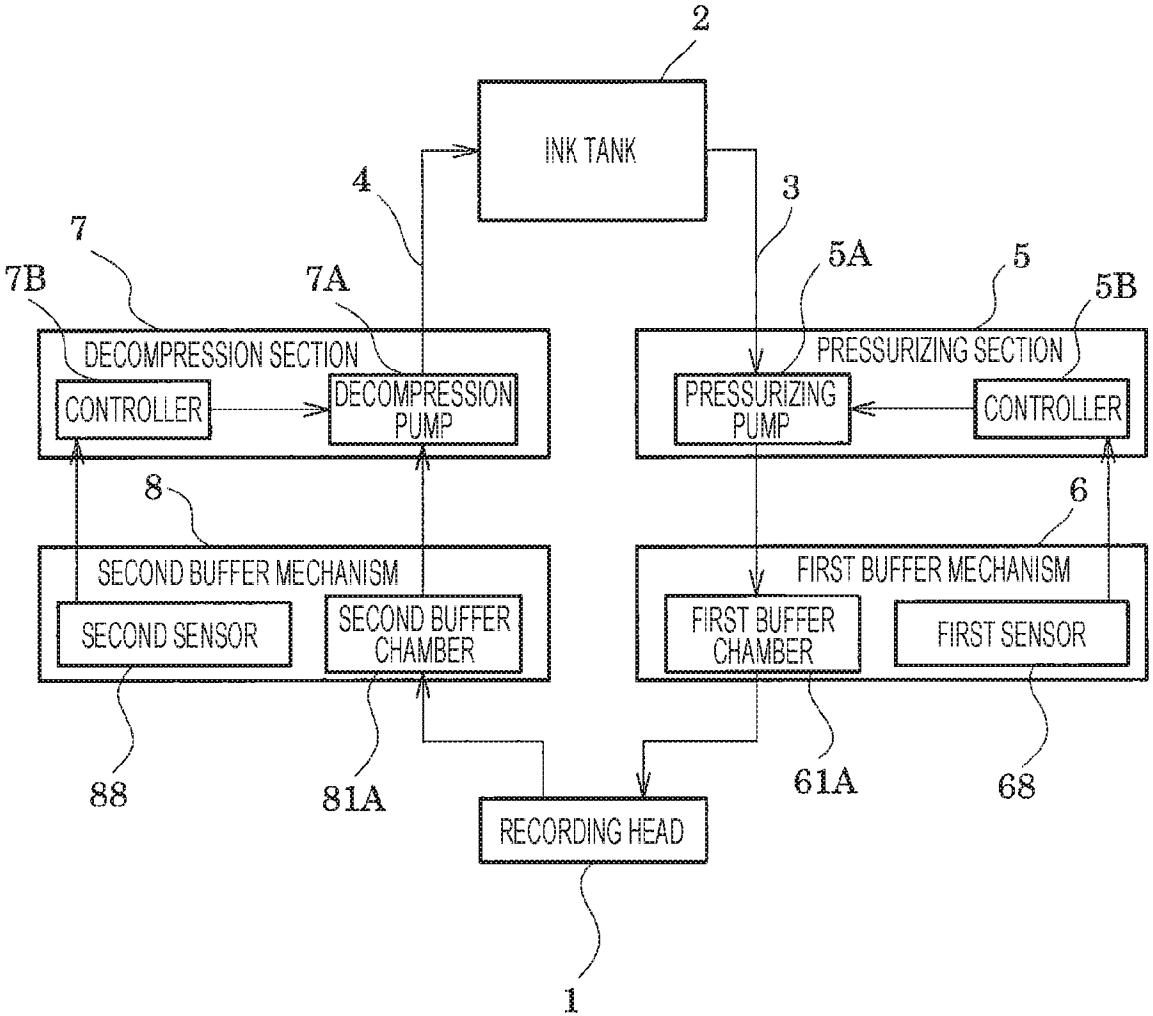
FIG. 1 is a block diagram illustrating a recording system.

An embodiment of the present disclosure will be described hereinafter with reference to the accompanying drawings. Note that the description below illustrates only one mode of the present disclosure and may be arbitrarily changed within the scope of the present disclosure. The same components are denoted by the same reference symbols in the drawings and descriptions thereof are appropriately omitted. Furthermore, X, Y, and Z indicate three spatial axes which are orthogonal to one another in the drawings. In this specification, directions along the X, Y, and Z axes are referred to as X, Y, and Z directions, respectively. It is assumed that directions indicated by arrows in the drawings are positive (+) directions and reversed directions of the directions indicated by the arrows are negative (−) directions. Furthermore, the Z direction corresponds to a first axis direction, the X direction corresponds to a second axis direction, and the Y direction corresponds to a third axis direction. Furthermore, terms "viewed in the X, Y, or Z direction" indicates a plan view in the X, Y, or Z direction.

First Embodiment

FIG. 1 is a block diagram schematically illustrating a configuration of an ink jet recording system which is an example of a liquid ejecting system according to a first embodiment of the present disclosure.

As illustrated in FIG. 1, an ink jet recording system (hereinafter simply referred to as a recording system where appropriate) which is an example of the liquid ejecting system according to this embodiment includes an ink jet recording head 1 (hereinafter simply referred to as a recording head 1 where appropriate), an ink tank 2, a supply channel 3, and a recovery channel 4.

Although described in detail hereinafter, the recording head 1 includes a plurality of nozzles which eject ink being liquid as ink droplets and channels coupled to the nozzles.

The ink tank 2 stores ink to be supplied to the recording head 1.

The supply channel 3 supplies the ink from the ink tank 2 to the recording head 1 and is configured by a tube-like member, such as a flexible tube, in this embodiment.

Furthermore, the supply channel 3 includes a pressurizing section 5 and a first buffer mechanism 6 disposed between the nozzles and the pressurizing section 5.

The pressurizing section 5 is used to supply the ink of the ink tank 2 by pressure to the recording head 1 and includes a pressurizing pump 5A and a controller 5B.

The controller 5B controls operation of the pressurizing pump 5A, that is, supply of the ink by the pressurizing pump 5A and stop of the supply of the ink by the pressurizing pump 5A. The controller 5B includes a switching element which supplies electric power or which stops the supply of the electric power to the pressurizing pump 5A and a switching controller controlling the switching element, for example. Although described in detail hereinafter, the controller 5B controls operation of the pressurizing pump 5A based on a detection signal supplied from a first sensor 68 which detects a buffer capacity of the first buffer mechanism 6.

When a positive pressure is generated by the pressurizing section 5 on a downstream of the supply channel 3, that is, a side coupled to the first buffer mechanism 6, the ink is supplied from the ink tank 2 through the first buffer mechanism 6 to the recording head 1. Note that, although not particularly illustrated, a check valve which allows only flow of ink from the pressurizing pump 5A to the first buffer mechanism 6 is disposed between the pressurizing pump 5A and the first buffer mechanism 6 in the supply channel 3.

The first buffer mechanism 6 including a first buffer chamber 61A coupled to the supply channel 3 controls pressure applied by the pressurizing section 5 by changing a buffer capacity which is volume of the first buffer chamber 61A so as to supply the ink of the ink tank 2 to the recording head 1 with predetermined pressure. The first buffer mechanism 6 will be described hereinafter in detail.

The recovery channel 4 is used to collect the ink supplied from the recording head 1 to the ink tank 2 and is constituted by a tube-like member, such as a flexible tube, in this embodiment.

Furthermore, the recovery channel 4 includes a decompression section 7 and a second buffer mechanism 8 disposed between the nozzles and the decompression section 7.

The decompression section 7 is used to supply the ink of the recording head 1 to the ink tank by applying pressure and includes a decompression pump 7A, such as a vacuum pump, and a controller 7B.

The controller 7B controls operation of the decompression pump 7A, that is, suction of the ink by the decompression pump 7A and stop of the suction of the ink by the decompression pump 7A. The controller 7B includes a switching element which supplies electric power or which stops the supply of the electric power to the decompression pump 7A and a switching controller controlling the switching element, for example. Although described in detail hereinafter, the controller 7B controls operation of the decompression pump 7A based on a detection signal supplied from a second sensor 88 which detects a buffer capacity of the second buffer mechanism 8. Note that the controller 5B controlling the pressurizing section 5 and the controller 7B controlling the decompression section 7 may be separately provided as described in this embodiment or may be integrated so as to comprehensively control the pressurizing pump 5A and the decompression pump 7A.

When a negative pressure is generated by the decompression section 7 on an upstream of the recovery channel 4, that is, a side coupled to the second buffer mechanism 8, the ink is collected from the recording head 1 to the ink tank 2. Note that, although not particularly illustrated, a check valve which allows only flow of ink from the second buffer mechanism 8 to the decompression pump 7A is disposed between the decompression pump 7A and the second buffer mechanism 8 in the recovery channel 4.

The second buffer mechanism 8 including a second buffer chamber 81A coupled to the recovery channel 4 controls pressure of the decompression section 7 by changing a buffer capacity C2 which is volume of the second buffer chamber 81A so as to collect the ink of the recording head 1 into the ink tank 2 with predetermined pressure.

Here, the ink jet recording head 1 which is an example of the liquid ejecting head of this embodiment will be described with reference to FIG. 2.

Figure 2:
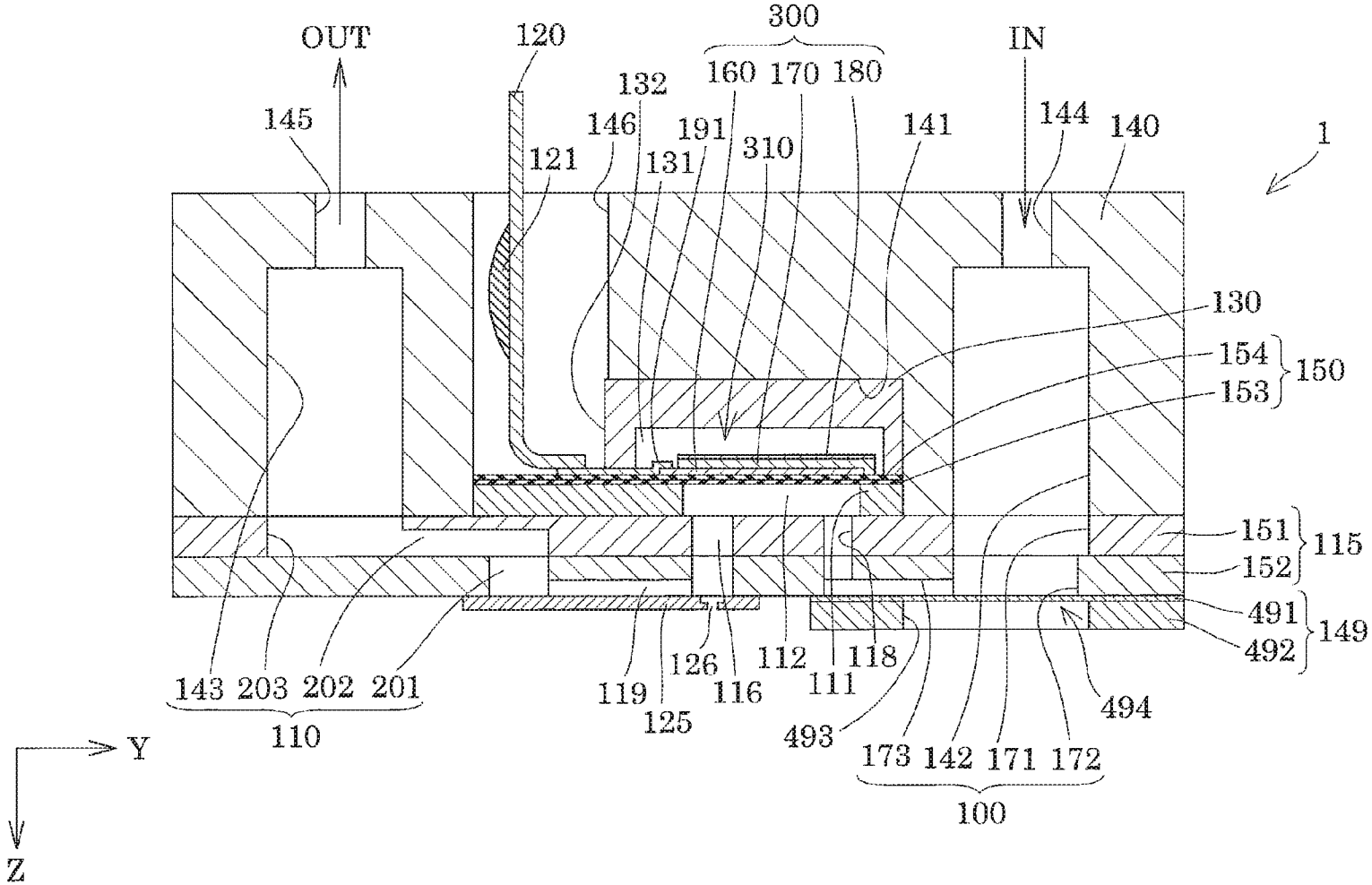
FIG. 2 is a sectional view of a recording head.

As illustrated in FIG. 2, a channel forming substrate 111 included in the recording head 1 is formed of metal, such as stainless steel or nickel (Ni), ceramic material, such as $ZrO_2$ or $AL_2O_3$, glass ceramic material, or oxide, such as MgO or $LaAlO_3$. In this embodiment, the channel forming substrate 111 is a silicon substrate. On the channel forming substrate 111, a plurality of pressure generation chambers 112 which are obtained by separation using a plurality of partitions formed by anisotropic etching performed from one side are arranged in parallel in the X direction.

A vibration plate 150 is formed at a surface on a −Z side of the channel forming substrate 111. In this embodiment, the vibration plate 150 includes an elastic film 153 formed of silicon oxide disposed near the channel forming substrate 111 and an insulation film 154 formed of zirconium oxide disposed on the elastic film 153.

A piezoelectric actuator 300 including a first electrode 160, a piezoelectric layer 170, and a second electrode 180 is disposed on the vibration plate 150 on the channel forming substrate 111. In this embodiment, the piezoelectric actuator 300 serves as a pressure generation section which causes a change in pressure of the ink in the pressure generation chambers 112.

The first electrode 160 is disposed on a surface of the vibration plate 150 on the −Z side. The first electrode 160 is divided by the pressure generation chambers 112 and forms discrete electrodes which are independent for active sections substantially serving as driving sections of the piezoelectric actuator 300.

The piezoelectric layer 170 is formed of piezoelectric material of oxide having a polarized structure formed on the first electrode 160. The piezoelectric layer 170 may be formed of perovskite oxide ($ABO_3$), for example, and lead-based piezoelectric material including lead or non-lead-based piezoelectric material which does not include lead may be used.

The second electrode 180 is disposed on a surface of the piezoelectric layer 170 on the −Z side. The second electrode 180 may be continuously disposed over the plurality of pressure generation chambers 112 and forms a common electrode for the plurality of active sections.

A discrete line 191 which is lead-out wiring is lead from the first electrode 160 of the piezoelectric actuator 300. Furthermore, a common line (not illustrated) which is lead-out wiring is lead from the second electrode 180. Then a flexible cable 120 is coupled to the discrete line 191 and the common line. The flexible cable 120 is a flexible wiring substrate, and a driving circuit 121 which is a semiconductor element is implemented on the flexible cable 120 in this embodiment.

A protection substrate 130 which is substantially as large as the channel forming substrate 111 is coupled to a surface of the channel forming substrate 111 on the −Z side. The protection substrate 130 has a holding section 131 which is a space for protecting the piezoelectric actuator 300. Furthermore, the protection substrate 130 has a through hole 132 penetrating in the Z direction. An end portion of the discrete line 191 drawn from the first electrode 160 of the piezoelectric actuator 300 and an end portion of the common line drawn from the second electrode 180 extend so as to be exposed in the through hole 132 and are electrically coupled to the flexible cable 120 in the through hole 132.

On the other hand, a communication plate 115 and a nozzle plate 125 are successively stacked on a surface of the channel forming substrate 111 on the +Z direction.

A nozzle 126 ejecting ink droplets is disposed on the nozzle plate 125. The nozzle 126 of the nozzle plate 125 communicates with the pressure generation chamber 112 through a nozzle communication path 116 formed at the communication plate 115.

The communication plate 115 includes a first communication plate 151 and a second communication plate 152 in this embodiment. The first communication plate 151 and the second communication plate 152 are laminated in the Z direction so that the first communication plate 151 is on the −Z side and the second communication plate 152 is on the +Z side.

The first communication plate 151 and the second communication plate 152 are formed of metal, such as stainless steel or nickel (Ni) or ceramics, such as zirconium (Zr). In this embodiment, a silicon substrate is used as the first communication plate 151 and the second communication plate 152 similarly to the channel forming substrate 111.

The communication plate 115 includes a first manifold section 171, a second manifold section 172, and a third manifold section 173 which communicate with the plurality of pressure generation chambers 112. The first manifold section 171, the second manifold section 172, and the third manifold section 173 which are disposed on the communication plate 115 and a fourth manifold section 142 disposed on a case member 140 described below in detail constitute a manifold 100 communicating with the plurality of pressure generation chambers 112 in common.

The first manifold section 171 penetrates the first communication plate 151 in the Z direction. The second manifold section 172 penetrates the second communication plate 152 in the Z direction. The third manifold section 173 does not penetrate the second communication plate 152 in the Z direction and is opened on a surface of the second communication plate 152 on the +Z side. The third manifold section 173 communicates with an end portion of the second manifold section 172 in the −Y direction.

Supply communication paths 118 communicating with end portions of the pressure generation chambers 112 in the +Y direction are independently disposed on the communication plate 115 for individual pressure generation chambers 112. The third manifold section 173 and the individual pressure generation chambers 112 communicate with each other through the supply communication path 118. Specifically, the supply communication path 118 is arranged in parallel to the third manifold section 173 in the X direction.

Furthermore, a circulation communication path 119, a first circulation manifold section 201, a second circulation manifold section 202, and a third circulation manifold section 203 are disposed on the communication plate 115.

The circulation communication path 119 does not penetrate the second communication plate 152 in the Z direction and is opened on a surface of the second communication plate 152 in the +Z direction. The circulation communication path 119 is disposed for each nozzle communication path 116 so that an end portion of the circulation communication path 119 in the +Y direction communicates with a corresponding one of the nozzle communication paths 116.

The first circulation manifold section 201 penetrates the second communication plate 152 in the Z direction. The first circulation manifold section 201 communicates with the plurality of circulation communication paths 119 in common and is continuously disposed in the X direction over the plurality of circulation communication paths 119 arranged in parallel. The other ends of the circulation communication paths 119 communicate with an end portion of the first circulation manifold section 201 in the +Y direction.

The second circulation manifold section 202 does not penetrate the first communication plate 151 in the Z direction and is opened on a surface of the first communication plate 151 on the +Z side. Specifically, the second circulation manifold section 202 is disposed on a coupling surface between the first communication plate 151 and the second communication plate 152.

The third circulation manifold section 203 penetrates the first communication plate 151 in the Z direction.

Then the first circulation manifold section 201, the second circulation manifold section 202, and the third circulation manifold section 203 disposed on the communication plate 115, and a fourth circulation manifold section 143 disposed on the case member 140 described below in detail constitute a circulation manifold 110.

In the recording head 1 configured as described above, ink is supplied from the manifold 100 to the supply communication path 118, the pressure generation chambers 112, and the nozzle communication paths 116, and the ink supplied to the nozzle communication path 116 is supplied to the circulation manifold 110 through the circulation communication paths 119.

The case member 140 is fixed on a −Z side of the protection substrate 130 and the communication plate 115. The case member 140 is substantially the same as the communication plate 115 described above in shape in a plan view and is coupled to both the protection substrate 130 and the communication plate 115. Specifically, the case member 140 has a recessed portion 141 accommodating the channel forming substrate 111 and the protection substrate 130. The recessed portion 141 has an opening area larger than that of the protection substrate 130. An opening surface of the recessed portion 141 in the +Z direction is sealed by the communication plate 115 in a state in which the channel forming substrate 111 and the protection substrate 130 are accommodated in the recessed portion 141.

The case member 140 includes the fourth manifold section 142 which is opened on a surface of the case member 140 in the Z direction on one side of the case member 140 in the Y direction and the fourth circulation manifold section 143 which is opened on the surface of the case member 140 in the Z direction on the other side of the case member 140 in the Y direction.

As described above, the first manifold section 171, the second manifold section 172, and the third manifold section 173 which are disposed on the communication plate 115 and the fourth manifold section 142 disposed on the case member 140 constitute the manifold 100.

Furthermore, the first circulation manifold section 201, the second circulation manifold section 202, and the third circulation manifold section 203 which are disposed on the communication plate 115 and the fourth circulation manifold section 143 disposed on the case member 140 constitute the circulation manifold 110.

Moreover, an inlet 144 which communicates with the manifold 100 and which is used to supply ink to the manifold 100 and an outlet 145 which communicates with the circulation manifold 110 and which is used to discharge ink from the circulation manifold 110 are disposed on the case member 140.

A compliance substrate 149 is disposed on a surface of the communication plate 115 on the +Z side. The compliance substrate 149 seals openings of the second manifold section 172 and the third manifold section 173 on the +Z side. The compliance substrate 149 includes a thin sealing film 491 having flexibility and a fixing substrate 492 formed of hard material, such as metal. A region of the fixing substrate 492 which faces the manifold 100 corresponds to an opening section 493 formed by totally removing the region in a thickness direction, and therefore, one of the surfaces of the manifold 100 corresponds to a compliance section 494 which is a flexible section sealed only by the sealing film 491 having flexibility. The compliance substrate 149 absorbs a pressure change in the manifold 100 or the like when the compliance section 494 bends.

Furthermore, the compliance substrate 149 may be formed only by the fixing substrate 492. Specifically, a thickness of a portion of the fixing substrate 492 is reduced so that the portion serves as the compliance section 494 absorbing a pressure change in the manifold 100.

Furthermore, a coupling port 146 through which the flexible cable 120 is inserted communicates with the through hole 132 of the protection substrate 130 and is disposed on the case member 140.

The manifold 100, the pressure generation chambers 112, and the circulation manifold 110 are filled with ink when the ink is supplied from the ink tank 2 through the supply channel 3 to the inlet 144. Furthermore, the ink supplied to the circulation manifold 110 is collected from the outlet 145 through the recovery channel 4 into the ink tank 2. By this, ink circulation is performed between the recording head 1 and the ink tank 2.

Figure 3:
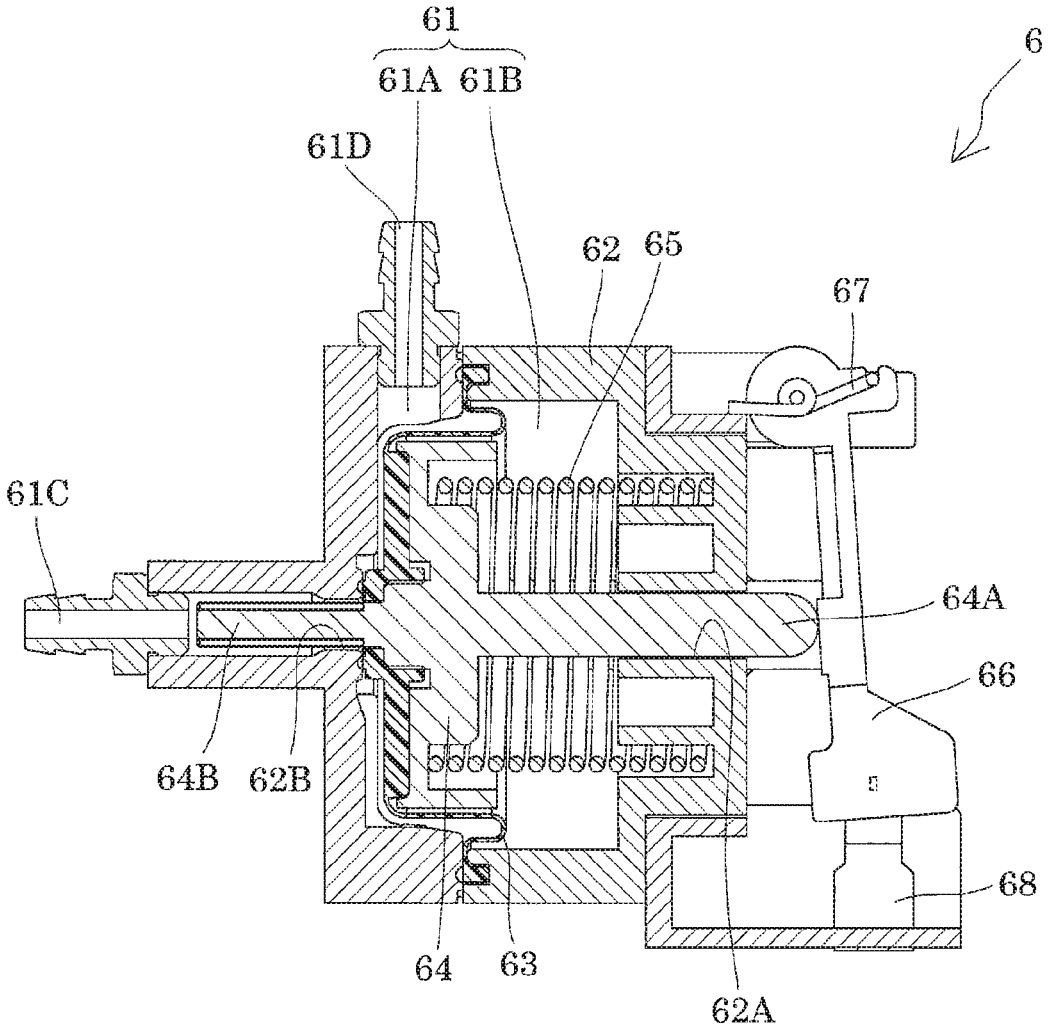
FIG. 3 is a sectional view of a first buffer mechanism.
Figure 4:
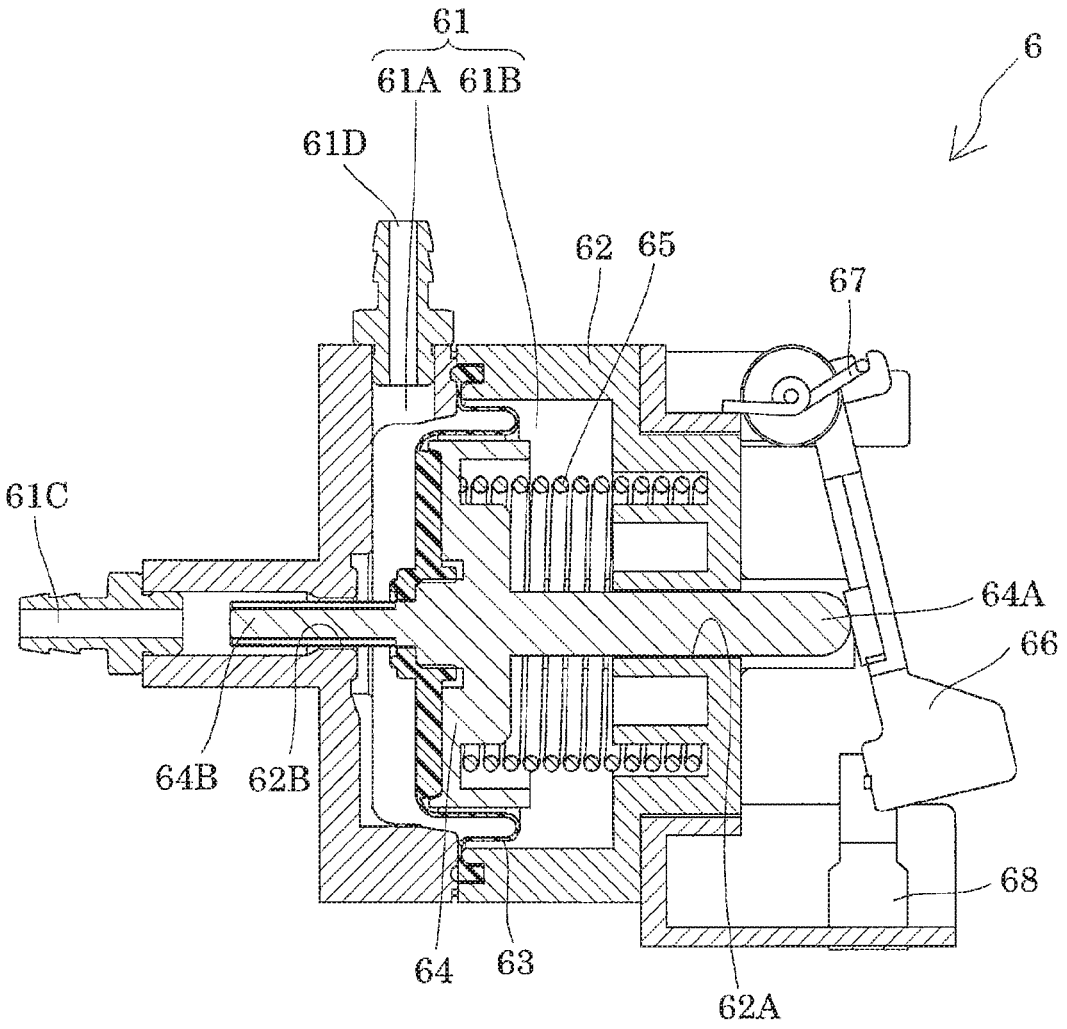
FIG. 4 is a sectional view of the first buffer mechanism.
Figure 5:
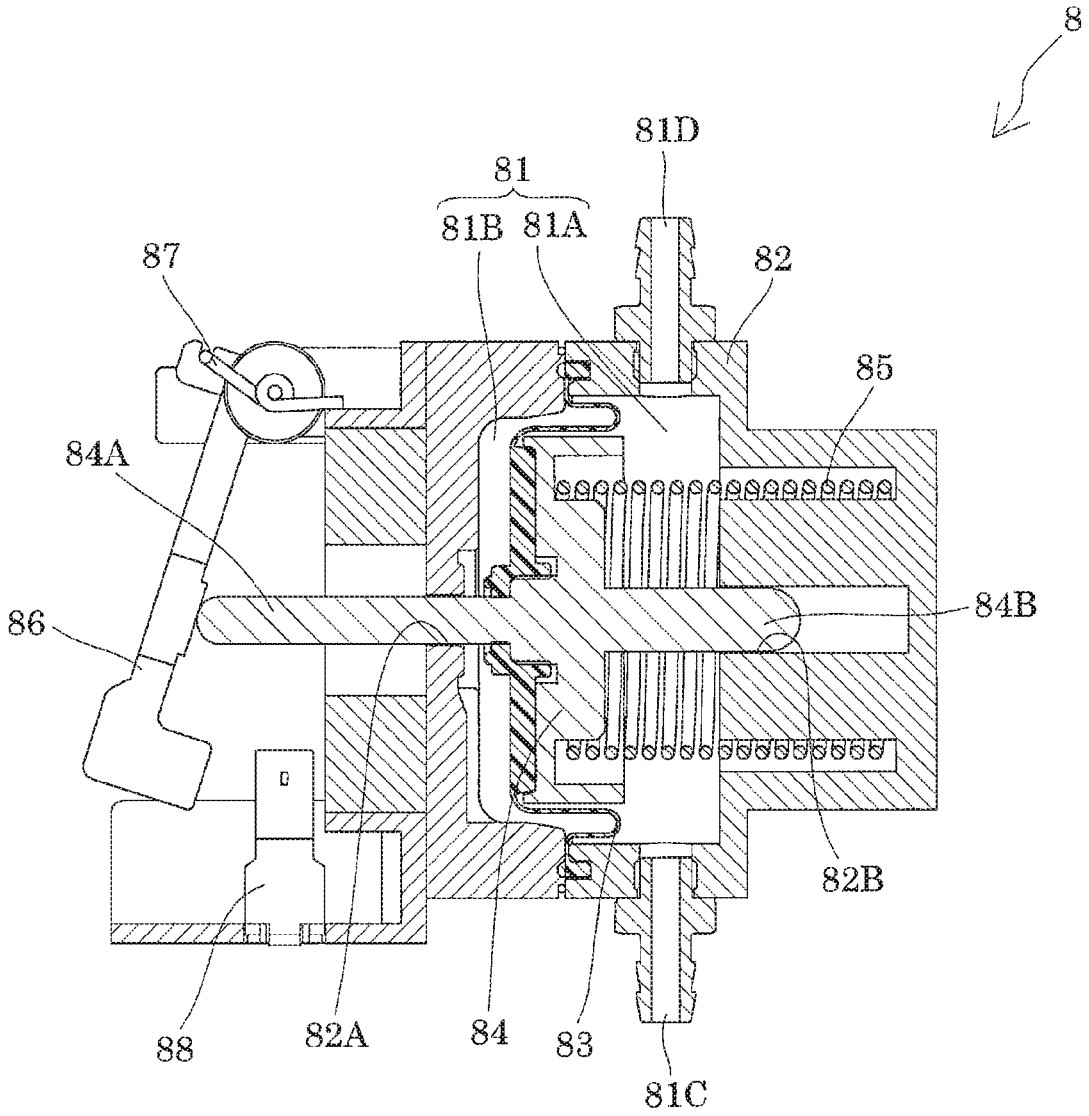
FIG. 5 is a sectional view of a second buffer mechanism.
Figure 6:
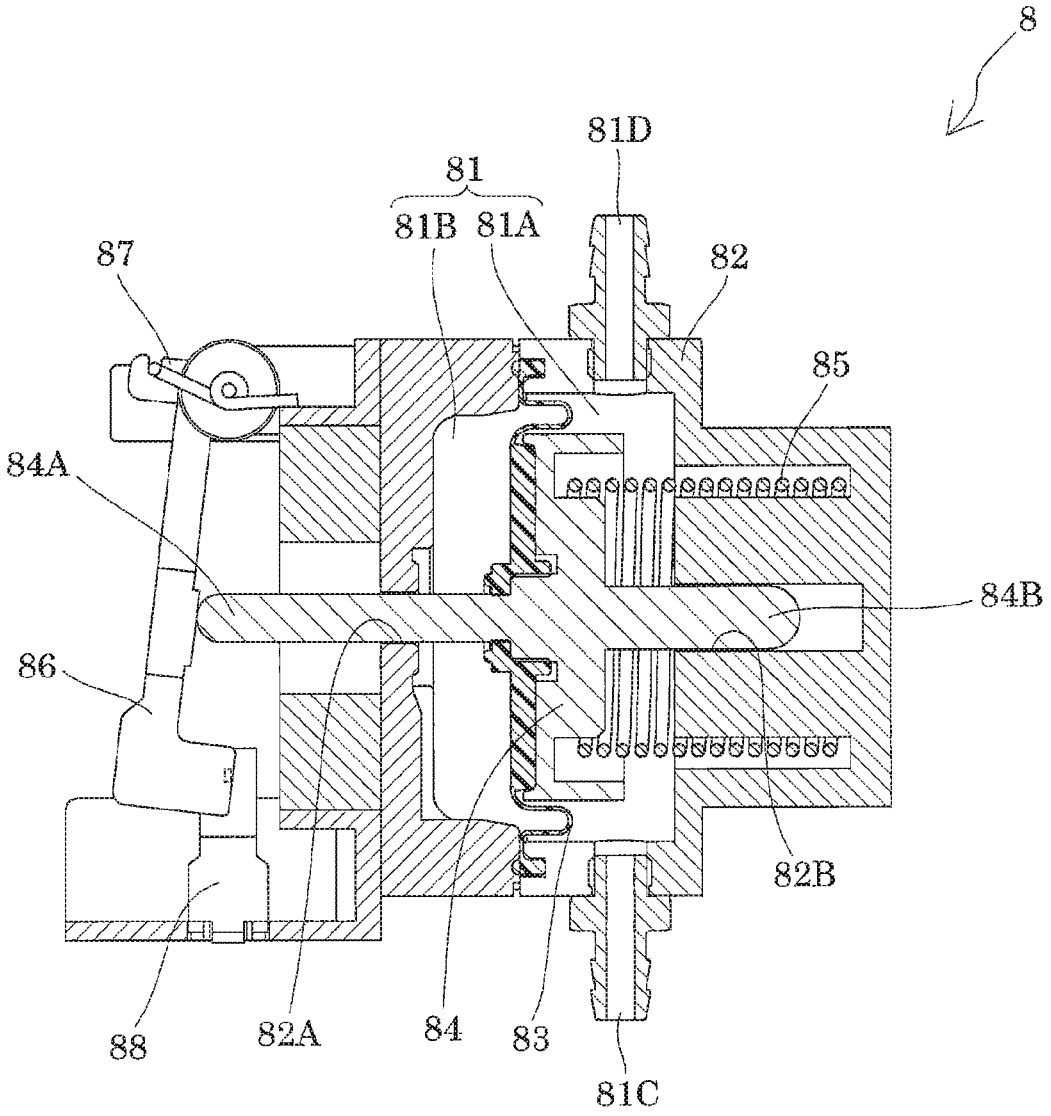
FIG. 6 is a sectional view of the second buffer mechanism.

The first buffer mechanism 6 and the second buffer mechanism 8 will now be described with reference to FIGS. 3 to 6. Note that FIGS. 3 and 4 are sectional views of the first buffer mechanism 6. FIGS. 5 and 6 are sectional views of the second buffer mechanism 8.

As illustrated in FIGS. 3 and 4, the first buffer mechanism 6 includes a first body section 62 having a first accommodation chamber 61.

The first accommodation chamber 61 has a first flexible wall 63 which divides the first accommodation chamber 61 into two rooms. One of the rooms of the first accommodation chamber 61 sectioned by the first flexible wall 63 is the first buffer chamber 61A and the other is a first operation chamber 61B which is opened to the air.

The first buffer chamber 61A has a first supply port 61C coupled with the ink tank 2 through the supply channel 3 and a second supply port 61D coupled with the recording head 1 through the supply channel 3. The ink included in the ink tank 2 is supplied to the first buffer chamber 61A through the first supply port 61C and the ink included in the first buffer chamber 61A is supplied to the recording head 1 through the second supply port 61D.

The first flexible wall 63 is a diaphragm forming a portion of a wall of the first buffer chamber 61A. When the first flexible wall 63 is deformed, capacity of the first buffer chamber 61A (also referred to as a buffer capacity hereinafter) is increased or reduced. The first flexible wall 63 may be formed of material having resistance against ink which is liquid, such as elastic material including gum or elastomer or film resin material.

Furthermore, a first operation plate 64 is disposed on a surface of the first flexible wall 63 on a side of the first operation chamber 61B. The first operation plate 64 has a first shaft section 64A projecting toward the first operation chamber 61B and a second shaft section 64B projecting toward the first buffer chamber 61A which are coaxially disposed.

The first body section 62 has a first bearing hole 62A to which the first shaft section 64A is inserted and a second bearing hole 62B to which the second shaft section 64B is inserted. The first shaft section 64A and the second shaft section 64B are inserted into the first bearing hole 62A and the second bearing hole 62B, respectively, so that the first operation plate 64 may reciprocate in a shaft direction of the first shaft section 64A and the second shaft section 64B.

Note that the first bearing hole 62A is used for communication between the first operation chamber 61B and an outside, and the first operation chamber 61B is opened to the air by the first bearing hole 62A.

Furthermore, the second bearing hole 62B communicates with the first buffer chamber 61A, and the first supply port 61C is disposed at an end portion of the second bearing hole 62B. Specifically, the ink supplied from the first supply port 61C is supplied to the first buffer chamber 61A through the second bearing hole 62B.

Furthermore, a first biasing section 65 biasing the first flexible wall 63 in a direction in which the buffer capacity of the first buffer chamber 61A is reduced is disposed on the first body section 62. In this embodiment, a compression coil spring is disposed to bias the first flexible wall 63 toward the first buffer chamber 61A in the first operation chamber 61B. Specifically, the first biasing section 65 of the compression coil spring is disposed in the first operation chamber 61B such that one end of the first biasing section 65 abuts on the first operation plate 64 and the other end abuts on a wall of the first body section 62 facing the first operation plate 64. In this way, since the first biasing section 65 is disposed on the first flexible wall 63 outside the first buffer chamber 61A, the first flexible wall 63 is biased by the first biasing section 65 in the direction in which the capacity of the first buffer chamber 61A is reduced.

Here, a reaction force of the first flexible wall 63, a biasing force of the first biasing section 65, and a force acting due to pressure Pin of the ink included in the first buffer chamber 61A act on the first flexible wall 63.

The reaction force of the first flexible wall 63 acts when the deformed first flexible wall 63 is to be restored. As an amount of deformation of the first flexible wall 63, that is, an amount of bend, becomes large, the reaction force of the first flexible wall 63 is increased. The reaction force of the first flexible wall 63 acts in a direction in which the volume of the first buffer chamber 61A is reduced.

The biasing force of the first biasing section 65 acts on the first flexible wall 63 in a direction in which the volume of the first buffer chamber 61A is reduced.

A force acting on the first flexible wall 63 by the pressure Pin of the ink included in the first buffer chamber 61A is represented by a product of a difference between the pressure Pin of the ink included in the first buffer chamber 61A and reference pressure outside the first flexible wall 63, that is, reference pressure of atmospheric pressure in this embodiment, and an area of the first flexible wall 63, that is, a so-called pressure-receiving area. The pressure Pin of the ink included in the first buffer chamber 61A is determined in accordance with an amount of ink supplied by the pressurizing section 5 to the first buffer chamber 61A through the first supply port 61C and an amount of ink discharged on downstream from the first buffer chamber 61A through the second supply port 61D, and is represented as a positive pressure relative to the atmospheric pressure.

As the pressure Pin of the ink included in the first buffer chamber 61A is increased, the first flexible wall 63 moves such that a buffer capacity C1 of the first buffer chamber 61A is increased against the reaction force of the first flexible wall 63 and the biasing force of the first biasing section 65 as illustrated in FIG. 4. Therefore, the ink pressure Pin of the ink included in the first buffer chamber 61A may be controlled by controlling a buffer capacity C1 of the first buffer chamber 61A as described below. The pressure Pin of the ink included in the first buffer chamber 61A controlled through the control of a buffer capacity C1 of the first buffer chamber 61A corresponds to pressure of the ink to be supplied to the recording head 1.

Furthermore, the first buffer mechanism 6 includes a detection mechanism detecting a capacity of the first buffer chamber 61A. The detection mechanism detecting a capacity of the first buffer chamber 61A of this embodiment includes a first movable section 66 axially supported by the first body section 62 in a turning manner in accordance with the capacity of the first buffer chamber 61A, a first movable section biasing section 67 biasing the first movable section 66, and a first sensor 68 detecting a turning angle of the first movable section 66.

The first movable section 66 is disposed in a position corresponding to an opening of the first bearing hole 62A outside the first operation chamber 61B and has a base end portion axially supported by the first body section 62 in a turning manner.

Furthermore, the first body section 62 includes the first movable section biasing section 67 biasing the first movable section 66 toward the first operation chamber 61B. The first movable section biasing section 67 of this embodiment includes a twist coil spring disposed on an outer circumference of a turning shaft of the first movable section 66.

When a capacity of the first buffer chamber 61A is small as illustrated in FIG. 3, the first movable section 66 is biased toward the first operation chamber 61B by a biasing force of the first movable section biasing section 67 and turns toward the first operation chamber 61B.

Furthermore, as illustrated in FIG. 4, when the capacity of the first buffer chamber 61A is increased due to deformation of the first flexible wall 63, a tip end of the first shaft section 64A of the first operation plate 64 presses the first movable section 66 in a direction in which the tip end moves away from the first operation chamber 61B against the biasing force of the first movable section biasing section 67, and the first movable section 66 moves in a turning manner in a direction in which the first movable section 66 moves away from the first operation chamber 61B. Specifically, in this embodiment, the biasing force of the first movable section biasing section 67 acts on the first flexible wall 63 in a direction in which the capacity of the first buffer chamber 61A is reduced.

The first sensor 68 detects a turning position of the first movable section 66. The first sensor 68 of this embodiment is fixed on the first body section 62 and determines whether a tip end of the first movable section 66 is detected so as to determine whether a turning angle of the first movable section 66 is smaller or not smaller than a predetermined angle. Note that the turning angle of the first movable section 66 of this embodiment is obtained provided that a direction in which the tip end of the first movable section 66 is separated from the first operation chamber 61B is determined as a positive direction of the turning angle using a position of the tip end which is closest to the first operation chamber 61B as illustrated in FIG. 3 as a reference.

The first sensor 68 is disposed in a position which faces the tip end of the first movable section 66 when the first movable section 66 turns to a position closer to the first operation chamber 61B relative to the predetermined angle and is disposed in a position which does not face the tip end of the first movable section 66 when the first movable section 66 turns in a direction in which the first movable section 66 is separated from the first operation chamber 61B relative to the predetermined angle.

Accordingly, when the first sensor 68 detects the tip end of the first movable section 66, the first sensor 68 determines that the first movable section 66 is in a position at an angle smaller than the predetermined angle, whereas when the first sensor 68 does not detect the tip end of the first movable section 66, the first sensor 68 determines that the first movable section 66 is in a position at an angle not smaller than the predetermined angle. The first sensor 68 may be a non-contact sensor, such as an infrared sensor or an ultrasonic sensor, or a contact sensor, such as a switch which is opened or closed when abutting on the first movable section 66. In this embodiment, an infrared sensor capable of detecting the tip end of the first movable section 66 without contact with the first movable section 66 is used as the first sensor 68.

The detection mechanism having the first movable section 66, the first movable section biasing section 67, and the first sensor 68 may detect that the first movable section 66 is in a position at an angle smaller than the predetermined angle, that is, capacity of the first buffer chamber 61A is smaller than predetermined capacity, when the first sensor 68 detects the tip end of the first movable section 66. Furthermore, the detection mechanism may detect that the first movable section 66 is in a position at an angle not smaller than the predetermined angle, that is, the capacity of the first buffer chamber 61A is not smaller than the predetermined capacity when the first sensor 68 does not detect the tip end of the first movable section 66.

Note that the first sensor 68 is not limited to a sensor which detects the tip end position of the first movable section 66 and may be an encoder or the like which detects a turning angle of the first movable section 66. Furthermore, although the first movable section 66, the first movable section biasing section 67, and the first sensor 68 are included in the detection mechanism which detects the capacity of the first buffer chamber 61A in this embodiment, the present disclosure is not limited to this, and a sensor which directly detects a tip end position of the first shaft section 64A may be provided, for example, without using the first movable section 66.

In the first buffer mechanism 6 having the configuration described above, the first flexible wall 63 is deformed to a position in which the volume of the first buffer chamber 61A is reduced by a biasing force applied by the first biasing section 65 as illustrated in FIG. 3 when ink is not supplied from the pressurizing section 5 through the first supply port 61C to the first buffer chamber 61A. This state is referred to as a state in which the capacity of the first buffer chamber 61A is smallest. In the state in which the capacity of the first buffer chamber 61A is smallest, the first sensor 68 detects the tip end of the first movable section 66.

Furthermore, when the pressurizing section 5 supplies the ink from the ink tank 2 to the first buffer chamber 61A in a pressurized manner, the first flexible wall 63 is deformed against a reaction force of the first flexible wall 63, a biasing force of the first biasing section 65, and a biasing force of the first movable section biasing section 67 in accordance with increase in the pressure Pin in the first buffer chamber 61A and the buffer capacity C1 of the first buffer chamber 61A is increased as illustrated in FIG. 4. In this way, when the first flexible wall 63 is deformed, the first operation plate 64 is moved to press the first movable section 66 in a direction in which the first movable section 66 is separated from the first operation chamber 61B so that the first movable section 66 turns. When the tip end of the first movable section 66 moves to a position which does not face the first sensor 68, the first sensor 68 determines that the tip end of the first movable section 66 is not detected. In this way, the first sensor 68 detects that the first buffer chamber 61A has a set buffer capacity C1set. In this way, when the first sensor 68 detects the set buffer capacity C1set of the first buffer chamber 61A, the controller 5B of the pressurizing section 5 performs control such that supply of the ink from the pressurizing pump 5A is stopped.

Thereafter, when the ink in the first buffer chamber 61A is reduced since the ink is supplied to the recording head 1 and the pressure Pin of the ink in the first buffer chamber 61A is reduced, the first flexible wall 63 is deformed in a direction in which the buffer capacity C1 of the first buffer chamber 61A is reduced, the first movable section 66 which has been pressed by the first operation plate 64 is moved to an original position by the biasing force of the first movable section biasing section 67, and the tip end of the first movable section 66 is moved to the position facing the first sensor 68 as illustrated in FIG. 3. When the first sensor 68 detects the tip end of the first movable section 66, the first sensor 68 determines that the capacity of the first buffer chamber 61A is smaller than the set buffer capacity C1set, that is, the pressure Pin of the ink in the first buffer chamber 61A is reduced and the pressure Pin of the ink supplied to the recording head 1 is reduced. When the first sensor 68 detects that the capacity of the first buffer chamber 61A is smaller than the set buffer capacity, pressurized supply of the ink by the pressurizing section 5 is to be started. Thereafter, when the capacity of the first buffer chamber 61A reaches the set buffer capacity C1set, the pressurized supply of the ink by the pressurizing section 5 is stopped as described above. In this way, since the buffer capacity C1 of the first buffer chamber 61A is detected by detecting a position of the first movable section 66 by the first sensor 68 and the pressurized supply and stop of the supply of the ink by the pressurizing section 5 is controlled based on a result of the detection, the set capacity C1set of the buffer capacity C1 of the first buffer chamber 61A, that is, the pressure Pin of the ink supplied to the recording head 1, may be maintained constant. As described above, the constant pressure control of the first buffer chamber 61A is performed by performing quantitative control on the buffer capacity set for a pressure value. Note that, when target pressure of the first buffer chamber 61A is to be changed, a setting value of the buffer capacity to be subjected to the quantitative control may be changed by changing a detection position of the first sensor 68.

On the other hand, the second buffer mechanism 8 includes a second body section 82 including a second accommodation chamber 81 as illustrated in FIGS. 5 and 6.

A second flexible wall 83 is disposed on the second accommodation chamber 81 which is divided into two rooms by the second flexible wall 83. One of the rooms of the second accommodation chamber 81 divided by the second flexible wall 83 is a second buffer chamber 81A, and the other is a second operation chamber 81B opened to the air.

The second buffer chamber 81A includes a first recovery port 81C coupled with the recording head 1 through the recovery channel 4 and a second recovery port 81D coupled with the ink tank 2 through the decompression section 7 and the recovery channel 4. The ink included in the recording head 1 is supplied from the first recovery port 81C to the second buffer chamber 81A, and the ink included in the second buffer chamber 81A is collected through the second recovery port 81D to the ink tank 2.

The second flexible wall 83 is a diaphragm forming a portion of a wall of the second buffer chamber 81A. When the second flexible wall 83 is deformed, volume (also referred to as a buffer capacity hereinafter) of the second buffer chamber 81A is increased or reduced. The second flexible wall 83 may be formed of material having resistance against ink which is liquid, such as elastic material including gum or elastomer, or film resin material.

Furthermore, a second operation plate 84 is disposed on a surface of the second flexible wall 83 on a side of the second buffer chamber 81A. The second operation plate 84 has a third shaft section 84A projecting toward the second operation chamber 81B and a fourth shaft section 84B projecting toward the second buffer chamber 81A which are coaxially disposed.

The second body section 82 has a third bearing hole 82A to which the third shaft section 84A is inserted and a fourth bearing hole 82B to which the fourth shaft section 84B is inserted. The third shaft section 84A and the fourth shaft section 84B are inserted into the third bearing hole 82A and the fourth bearing hole 82B, respectively, so that the second operation plate 84 may reciprocate in a shaft direction of the third shaft section 84A and the fourth shaft section 84B.

Note that the third bearing hole 82A is used for communication between the second operation chamber 81B and an outside, and the second operation chamber 81B is opened to the air through the third bearing hole 82A.

Furthermore, the second body section 82 includes a second biasing section 85 which biases the second flexible wall 83 in a direction in which a buffer capacity of the second buffer chamber 81A is increased. In this embodiment, a compression coil spring which biases the second flexible wall 83 toward the second operation chamber 81B is disposed in the second buffer chamber 81A. Specifically, the second biasing section 85 formed of the compression coil spring is disposed in the second buffer chamber 81A such that one end of the second biasing section 85 abuts on the second operation plate 84 and the other end abuts on a wall surface of the second buffer chamber 81A of the second body section 82 which faces the second operation plate 84. In this way, since the second biasing section 85 is disposed inside the second buffer chamber 81A of the second flexible wall 83, the second flexible wall 83 is biased in a direction in which the volume of the second buffer chamber 81A is increased by the second biasing section 85.

Here, a reaction force of the second flexible wall 83, a biasing force of the second biasing section 85, and a force acting due to pressure Pout of the ink included in the second buffer chamber 81A act on the second flexible wall 83.

The reaction force of the second flexible wall 83 acts when the deformed second flexible wall 83 is to be restored. As an amount of deformation of the second flexible wall 83, that is, an amount of bend, is large, the reaction force of the second flexible wall 83 is increased. The reaction force of the second flexible wall 83 acts in a direction in which the volume of the second buffer chamber 81A is reduced.

The biasing force acts on the second flexible wall 83 by the second biasing section 85 in a direction in which the volume of the second buffer chamber 81A is increased.

A force acting on the second flexible wall 83 by the pressure Pout of the ink included in the second buffer chamber 81A is represented by a product of a difference between the pressure Pout of the ink included in the second buffer chamber 81A and reference pressure outside the second flexible wall 83, that is, reference pressure of atmospheric pressure in this embodiment, and an area of the second flexible wall 83, that is, a so-called pressure-receiving area. The pressure Pout of the ink included in the second buffer chamber 81A is determined in accordance with an amount of ink collected from the second buffer chamber 81A through the second recovery port 81D by the decompression section 7 and an amount of ink supplied to the second buffer chamber 81A through the first recovery port 81C, and is represented to as a negative pressure relative to the atmospheric pressure.

As the pressure Pout of the ink included in the second buffer chamber 81A is reduced, that is, a negative pressure is increased, the second flexible wall 83 moves such that buffer capacity C2 of the second buffer chamber 81A is reduced against the reaction force of the second flexible wall 83 and the biasing force of the second biasing section 85 as illustrated in FIG. 6. Therefore, as described below, the pressure Pout of the ink included in the second buffer chamber 81A may be controlled by controlling the buffer capacity C2 of the second buffer chamber 81A. The pressure Pout of the ink included in the second buffer chamber 81A controlled by controlling the buffer capacity C2 of the second buffer chamber 81A is used to collect the ink from the recording head 1.

Furthermore, the second buffer mechanism 8 includes a detection mechanism detecting capacity of the second buffer chamber 81A. The detection mechanism detecting capacity of the second buffer chamber 81A of this embodiment includes a second movable section 86 axially supported by the second body section 82 in a turning manner in accordance with the capacity of the second buffer chamber 81A, a second movable section biasing section 87 biasing the second movable section 86, and a second sensor 88 detecting a turning angle of the second movable section 86.

The second movable section 86 is disposed in a position corresponding to an opening of the fourth bearing hole 82B outside the second operation chamber 81B, and has a base end portion axially supported by the second body section 82 in a turning manner.

Furthermore, the second body section 82 has a second movable section biasing section 87 biasing the second movable section 86 toward the second operation chamber 81B. The second movable section biasing section 87 of this embodiment is formed of a twist coil spring disposed on an outer circumference of a turning shaft of the second movable section 86.

When capacity of the second buffer chamber 81A is large, a tip end of the third shaft section 84A of the second operation plate 84 presses the second movable section 86 against a biasing force of the second movable section biasing section 87 so that the second movable section 86 moves to separate from the second operation chamber 81B in a turning manner as illustrated in FIG. 5.

Furthermore, as illustrated in FIG. 6, when the capacity of the second buffer chamber 81A is reduced since the second flexible wall 83 is deformed, the second movable section 86 moves toward the second operation chamber 81B by the biasing force of the second movable section biasing section 87 in a turning manner. Specifically, the biasing force of the second movable section biasing section 87 acts on the second flexible wall 83 in a direction in which the capacity of the second buffer chamber 81A is reduced.

The second sensor 88 detects a turning position of the second movable section 86. The second sensor 88 of this embodiment is fixed on the second body section 82 and determines whether a tip end of the second movable section 86 is detected so as to determine whether a turning angle of the second movable section 86 is smaller or not smaller than a predetermined angle. Note that the turning angle of the second movable section 86 of this embodiment is obtained provided that a direction in which the tip end of the second movable section 86 is separated from the second operation chamber 81B is determined as a positive direction of the turning angle using a position of the tip end of the second movable section 86 which is close to the second operation chamber 81B as illustrated in FIG. 6 as a reference.

The second sensor 88 is disposed in a position which faces the tip end of the second movable section 86 when the second movable section 86 turns to a position closer to the second operation chamber 81B relative to the predetermined angle, and is disposed in a position which does not face the tip end of the second movable section 86 when the second movable section 86 turns in a direction in which the second movable section 86 is separated from the second operation chamber 81B relative to the predetermined angle. By this, when the second sensor 88 detects the tip end of the second movable section 86, the second sensor 88 detects that the second movable section 86 is in a position at an angle not larger than the predetermined angle, whereas when the second sensor 88 does not detect the tip end of the second movable section 86, the second sensor 88 detects that the second movable section 86 is in a position at an angle larger than the predetermined angle. The second sensor 88 may be a non-contact sensor, such as an infrared sensor or an ultrasonic sensor, or a contact sensor, such as a switch which is opened or closed when abutting on the second movable section 86. In this embodiment, an infrared sensor capable of detecting a tip end of the first movable section 86 without contact with the second movable section 86 is used as the second sensor 88.

The detection mechanism having the second movable section 86, the second movable section biasing section 87, and the second sensor 88 may detect that the second movable section 86 is in a position at an angle not larger than the predetermined angle, that is, capacity of the second buffer chamber 81A is not larger than predetermined capacity, when the second sensor 88 detects the tip end of the second movable section 86. Furthermore, the detection mechanism may detect that the second movable section 86 is in a position at an angle larger than the predetermined angle, that is, the capacity of the second buffer chamber 81A is larger than the predetermined capacity, when the second sensor 88 does not detect the tip end of the second movable section 86.

Note that the second sensor 88 is not limited to a sensor which detects a tip end position of the second movable section 86 and may be an encoder or the like which detects a turning angle of the second movable section 86. Furthermore, although the second movable section 86, the second movable section biasing section 87, and the second sensor 88 are included in the detection mechanism which detects the capacity of the second buffer chamber 81A in this embodiment, the present disclosure is not limited to this, and a sensor which directly detects a tip end position of the third shaft section 84A may be provided without using the second movable section 86.

In the second buffer mechanism 8 having the configuration described above, the second flexible wall 83 is deformed to a position in which the capacity of the second buffer chamber 81A is increased by a biasing force applied by the second biasing section 85 as illustrated in FIG. 5 in a state in which a range from the second recovery port 81D to an inside of the second buffer chamber 81A is not decompressed by the decompression section 7. This state is referred to as a state in which the buffer capacity of the second buffer chamber 81A is maximum. In the state in which the buffer capacity of the second buffer chamber 81A is maximum, the second sensor 88 does not detect the tip end of the second movable section 86.

Furthermore, when the decompression section 7 decompresses the ink in the range from the second recovery port 81D to the inside of the second buffer chamber 81A, the second flexible wall 83 is deformed against a reaction force of the second flexible wall 83 and a biasing force of the second biasing section 85 in accordance with reduction in the pressure Pout in the second buffer chamber 81A and the buffer capacity C2 of the second buffer chamber 81A is reduced as illustrated in FIG. 6. In this way, when the second flexible wall 83 is deformed, the second operation plate 84 is moved to press the second movable section 86 in a direction in which the second movable section 86 is separated from the second operation chamber 81B so that the second movable section 86 turns with a base end portion at the center. When the tip end of the second movable section 86 moves to a position which faces the second sensor 88, the second sensor 88 detects the tip end of the second movable section 86. In this way, the second sensor 88 detects that the second buffer chamber 81A has a set buffer capacity C2set. When the second sensor 88 detects the set buffer capacity C2set of the second buffer chamber 81A, the controller 7B of the decompression section 7 performs control such that the decompression of the ink performed by the decompression pump 7A is stopped.

Thereafter, when the ink of the second buffer chamber 81A is increased since the ink is collected from the recording head 1 to the second buffer chamber 81A and the pressure Pout of the ink in the second buffer chamber 81A is increased, the second flexible wall 83 is deformed in a direction in which the buffer capacity C2 of the second buffer chamber 81A is increased, the second movable section 86 is pressed by the second operation plate 84 so that the tip end of the second movable section 86 is moved to a position which does not face the second sensor 88 as illustrated in FIG. 5. When the second sensor 88 does not detect the tip end of the second movable section 86, the second sensor 88 determines that the capacity of the second buffer chamber 81A is larger than the set buffer capacity C2set, that is, the pressure Pout of the ink collected from the recording head 1 is reduced. When the second sensor 88 detects that the capacity of the second buffer chamber 81A is larger than the set buffer capacity C2set, the decompression of the ink performed by the decompression section 7 is controlled to be started. Thereafter, as described above, when the capacity of the second buffer chamber 81A reaches the set buffer capacity C2set, the decompression of the ink performed by the decompression section 7 is stopped. In this way, since the buffer capacity C2 of the second buffer chamber 81A is detected by detecting a position of the second movable section 86 by the second sensor 88 and the decompression and stop of the decompression performed by the decompression section 7 is controlled based on a result of the detection, the set capacity C2set of the buffer capacity C2 of the second buffer chamber 81A, that is, the pressure Pout of the ink collected from the recording head 1, may be maintained constant. As described above, the constant pressure control of the second buffer chamber 81A is performed by performing quantitative control on the buffer capacity set for a pressure value. Note that, when a target pressure of the second buffer chamber 81A is to be changed, a setting value of the buffer capacity to be subjected to the quantitative control may be changed by changing a detection position of the second sensor 88.

As described above, the first buffer mechanism 6 supplies the ink of the ink tank 2 to the recording head 1 with the certain pressure Pin and the second buffer mechanism 8 collects the ink of the recording head 1 into the ink tank 2 with the certain pressure Pout, and therefore, circulation of the ink between the recording head 1 and the ink tank 2 may be frequently performed. Specifically, a change in pressure, such as a pulsation, of the pressurizing pump 5A which pressurizes the ink supplied from the ink tank 2 to the recording head 1 may be reduced using the first buffer mechanism 6, and therefore, variation of the pressure on the ink to be supplied to the recording head 1 may be suppressed. Similarly, a change in pressure, such as a pulsation, of the decompression pump 7A which decompresses the ink collected from the recording head 1 to the ink tank 2 may be reduced using the second buffer mechanism 8, and therefore, variation of the pressure on the ink to be collected from the recording head 1 may be suppressed. Accordingly, off-balance between supply pressure for supply of the ink between the ink tank 2 and the recording head 1 and recovery pressure for collecting the ink may be suppressed and circulation of the ink between the ink tank 2 and the recording head 1 may be frequently performed. When off-balance between the supply pressure and the recovery pressure of the ink occurs and the pressure of the ink in a nozzle position, that is, pressure of the ink in the nozzle 126 becomes a positive pressure, the ink may be leaked from the nozzles 126 of the recording head 1. Since the first buffer mechanism 6 and the second buffer mechanism 8 are provided, control may be easily performed with high accuracy such that the pressure of the ink in the nozzle position becomes negative, and therefore, leakage of the ink from the nozzles 126 may be suppressed.

Here, the relationship between the buffer capacity C1 of the first buffer chamber 61A of the first buffer mechanism 6 obtained in a period from when operation is started to when the circulation of the ink is stopped, the buffer capacity C2 of the second buffer chamber 81A of the second buffer mechanism 8, and pressure of the ink in the nozzles 126 of the recording head 1 in the ink jet recording system will be described with reference to FIG. 7.

In a state in which the ink jet recording system is stopped, that is, at a time of non-circulation in which the ink is not circulated between the ink tank 2 and the recording head 1, the pressurizing section 5 does not pressurize the ink, and therefore, the buffer capacity C1 of the first buffer chamber 61A of the first buffer mechanism 6 is a minimum capacity C1min as illustrated in FIG. 3.

Furthermore, at the time of the non-circulation in which the ink is not circulated, the ink is not decompressed by the decompression section 7 and the buffer capacity C2 of the second buffer chamber 81A of the second buffer mechanism 8 is a maximum capacity C2max as illustrated in FIG. 5.

Figure 7:
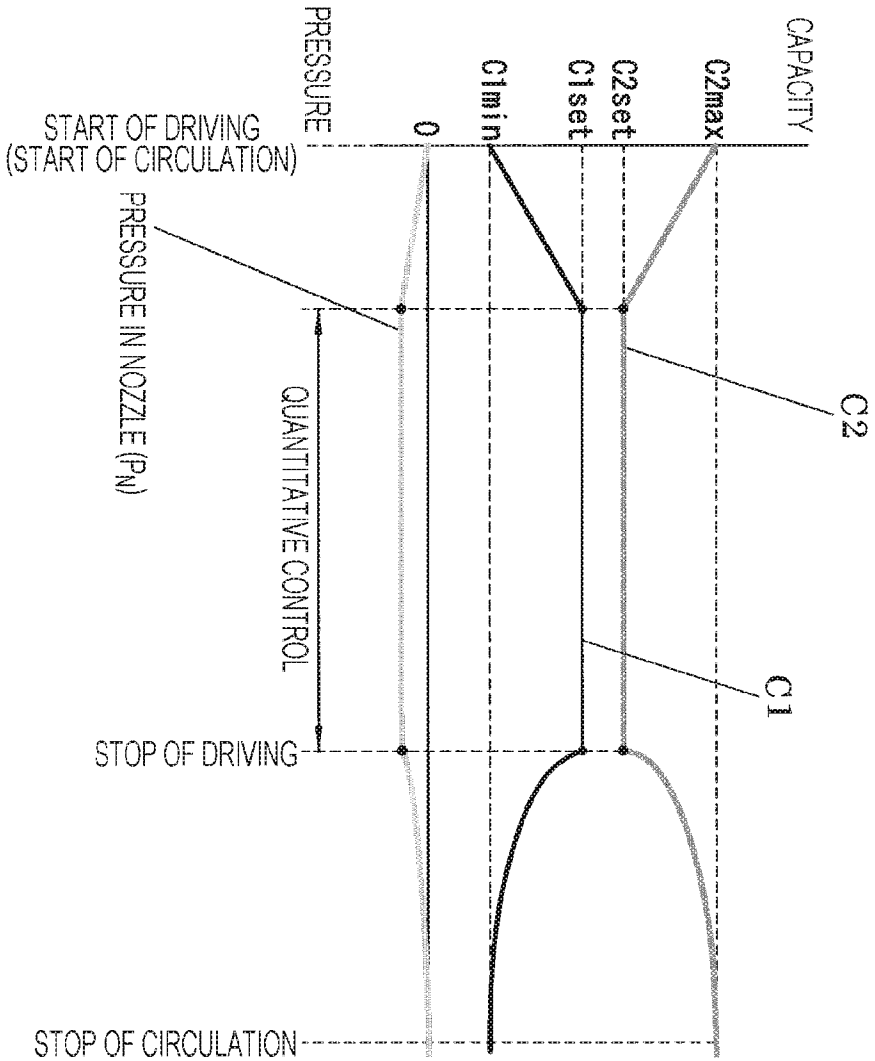
FIG. 7 is a graph representing relationship between buffer capacities and pressure in a nozzle.

As illustrated in FIG. 7, the buffer capacity C2max of the second buffer chamber 81A is larger than the buffer capacity C1min of the first buffer chamber 61A at the time of the non-circulation. Specifically, the relationship "C2max>C1min" is obtained.

When operation of the ink jet recording system is started, the pressurization and decompression of the ink are performed by the pressurizing section 5 and the decompression section 7, respectively, and the circulation of the ink between the ink tank 2 and the recording head 1 is started.

When the operation of the ink jet recording system is started, the buffer capacity C1 of the first buffer chamber 61A of the first buffer mechanism 6 is gradually increased from the minimum buffer capacity C1min illustrated in FIG. 3 to the set buffer capacity C1set detected by the first sensor 68 illustrated in FIG. 4. By this, the pressure Pin of the ink in the first buffer chamber 61A, that is, the pressure of the ink to be supplied to the recording head 1, is gradually increased, that is, a positive pressure is increased.

Similarly, when the operation of the ink jet recording system is started, the buffer capacity C2 of the second buffer chamber 81A of the second buffer mechanism 8 is gradually reduced from the maximum buffer capacity C2max illustrated in FIG. 5 to the set buffer capacity C2set detected by the second sensor 88 illustrated in FIG. 6. By this, the pressure Pout of the ink in the second buffer chamber 81A, that is, the pressure of the ink collected from the recording head 1, is gradually reduced, that is, a negative pressure is increased.

As described above, pressure $P_N$ of the ink included in the nozzle 126 of the recording head 1 is determined by a difference between the pressure Pin of the ink included in the first buffer chamber 61A and the pressure Pout of the ink included in the second buffer chamber 81A. For example, when a channel resistance in a range from the first buffer chamber 61A to the nozzles 126 is the same as a channel resistance in a range from the second buffer chamber 81A to the nozzles 126, a value represented by an absolute value of the pressure Pout of the ink of the second buffer chamber 81A is larger than a value represented by an absolute value of the pressure Pin of the ink of the first buffer chamber 61A so that the pressure $P_N$ of the ink included in the nozzles 126 may be a negative pressure relative to the atmospheric pressure. That is, when the relationship "|Pout|>|Pin|" is satisfied, the pressure $P_N$ of the ink included in the nozzles 126 may be a negative pressure relative to the atmospheric pressure.

Note that, in a case where a channel resistance in a range from the first buffer chamber 61A to the nozzles 126 is different from a channel resistance in a range from the second buffer chamber 81A to the nozzles 126, even when a value represented by an absolute value of the pressure Pout of the ink of the second buffer chamber 81A is not larger than a value represented by an absolute value of the pressure Pin of the ink of the first buffer chamber 61A, that is, the relationship "|Pout|<=|Pin| is satisfied, the pressure of the ink in the nozzles 126 may be negative relative to the atmospheric pressure. Specifically, when the channel resistance in the range from the first buffer chamber 61A to the nozzles 126 is larger than the channel resistance in the range from the second buffer chamber 81A to the nozzles 126 and a pressure loss in the range from the first buffer chamber 61A to the nozzle 126 is comparatively large, the pressure Pin of the ink in the first buffer chamber 61A is required to be comparatively large, and a value represented by an absolute value of the pressure Pout of the ink of the second buffer chamber 81A may be not larger than a value represented by an absolute value of the pressure Pin of the ink in the first buffer chamber 61A.

Therefore, the buffer capacity C1set of the first buffer chamber 61A and the buffer capacity C2set of the second buffer chamber 81A are set such that the pressure Pin of the ink in the first buffer chamber 61A and the pressure Pout of the ink in the second buffer chamber 81A controlled by the buffer capacity C2set are set such that the pressure $P_N$ of the ink in the nozzles 126 is negative relative to the atmospheric pressure.

Then, as illustrated in FIG. 7, in a quantitative control period in which the buffer capacity C1 of the first buffer chamber 61A is maintained as the set buffer capacity C1set and the buffer capacity C2 of the second buffer chamber 81A is maintained as the buffer capacity C2set, the set buffer capacity C2set of the second buffer chamber 81A is larger than the set buffer capacity C1set of the first buffer chamber 61A. Specifically, the relationship "C2set>C1set" is satisfied.

Thereafter, when the operation of the ink jet recording system is stopped, pressurized supply of the ink is not performed by the pressurizing section 5 and the buffer capacity C1 of the first buffer chamber 61A is reduced from the set buffer capacity C1set to the minimum buffer capacity C1min. Specifically, when the pressurizing section 5 does not perform pressurization in the state illustrated in FIG. 4 in which the first flexible wall 63 is deformed by applying pressure to the ink in the first buffer chamber 61A by the pressurizing section 5, the first flexible wall 63 returns to the original state illustrated in FIG. 3 by the reaction force of the first flexible wall 63, the biasing force of the first biasing section 65, and the biasing force of the first movable section biasing section 67. By this, the ink is supplied from the first buffer mechanism 6 to the recording head 1 by a capacity difference ΔC1 (ΔC1=C1set−C1min) which is a difference between the set buffer capacity C1set and the minimum buffer capacity C1min.

Similarly, when the operation of the ink jet recording system is stopped, decompression of the ink is not performed by the decompression section 7 and the buffer capacity C1 of the second buffer chamber 81A is increased from the set buffer capacity C2set to the maximum buffer capacity C2max. Specifically, when the decompression section 7 does not perform the decompression in the state illustrated in FIG. 6 in which the second flexible wall 83 is deformed since the decompression section 7 decompresses the ink of the second buffer chamber 81A, the second flexible wall 83 returns to the original state illustrated in FIG. 5 by the reaction force of the second flexible wall 83 and the biasing force of the second biasing section 85. By this, the ink is collected from the recording head 1 of the second buffer mechanism 8 by a capacity difference ΔC2 (ΔC2=C2max−C2set) which is a difference between the set buffer capacity C2set and the maximum buffer capacity C2max.

Therefore, when the capacity difference ΔC1 of the first buffer chamber 61A obtained in the circulation state and the non-circulation state is reduced to be smaller than the capacity difference ΔC2 of the second buffer chamber 81A, that is, ΔC1 is smaller than ΔC2, an amount of ink to be supplied from the first buffer mechanism 6 to the recording head 1 is reduced to be smaller than an amount of ink collected by the second buffer mechanism 8 from the recording head 1 in a period of time from the quantitative control period in which the circulation is performed to the non-circulation state in which the operation is stopped and the circulation of the ink is completely stopped. Accordingly, an amount of ink smaller than an amount of ink collected by the recording head 1 in the non-circulation state may be supplied, the pressure of the ink in the nozzles 126 of the recording head 1 may be negative relative to the atmospheric pressure even in a period of time from when the operation is stopped to when the circulation of the ink is completely stopped as illustrated in FIG. 7, and leakage of the ink from the nozzles 126 may be suppressed. Note that it is advantageous in that the capacity difference control of the buffer chamber described above acts in a self-control manner not only when the operation is intentionally stopped but also when the operation is accidentally stopped due to blackout, for example.

The time of the ink circulation in the ink jet recording system includes a period of time from when the operation is started to when the quantitative control period is started, the quantitative control period, and a period of time from when the operation is stopped to when the ink circulation is completely stopped, as illustrated in FIG. 7. Furthermore, even in a period of time from when the operation of the ink jet recording system is started to when the buffer capacity C1 of the first buffer chamber 61A is increased to the set capacity C1set from the minimum capacity C1min and the buffer capacity C2 of the second buffer chamber 81A is reduced to the set capacity C2set from the maximum capacity C2max, that is, a period of time from when the operation is started to when the quantitative control period is started, the pressure $P_N$ of the ink in the nozzles 126 may be maintained to be negative relative to the atmospheric pressure since the buffer capacity C1 of the first buffer chamber 61A is constantly maintained to be smaller than the buffer capacity C2 of the second buffer chamber 81A. Accordingly, leakage of the ink from the nozzles 126 may be suppressed even in the period of time from when the operation is started to when the quantitative control period is started. Note that the buffer capacity C1 of the first buffer chamber 61A in the period of time from when the operation is started to when the quantitative control period is started may not be reduced to be smaller than the buffer capacity C2 of the second buffer chamber 81A only by performing ON/OFF control of the pressurizing pump 5A and the decompression pump 7A using the first sensor 68 included in the first buffer mechanism 6 and the second sensor 88 included in the second buffer mechanism 8 of this embodiment. However, the buffer capacity C1 of the first buffer chamber 61A may be maintained to be constantly smaller than the buffer capacity C2 of the second buffer chamber 81A when capability of the pressurizing pump 5A and capability of the decompression pump 7A are the same, and therefore, a change rate of the buffer capacity of the first buffer chamber 61A and a change rate of the buffer capacity of the second buffer chamber 81A in the period of time from when the operation is started to when the quantitative control period is started, that is, an amount of increase in the buffer capacity of the first buffer chamber 61A in a unit of time and an amount of reduction in the buffer capacity of the second buffer chamber 81A in a unit of time, are the same.

Note that, when the capability of the pressurizing pump 5A and the capability of the decompression pump 7A are different from each other or when the channel resistance on the supply side and the channel resistance on the recovery side are considerably different from each other, it is difficult to maintain the buffer capacity C1 of the first buffer chamber 61A to be smaller than the buffer capacity C2 of the second buffer chamber 81A in the period from when the operation is started to before the quantitative control period is started. Therefore, a sensor capable of consecutively detecting the buffer capacity C1min to the buffer capacity C1set of the first buffer chamber 61A and a sensor capable of consecutively detecting the buffer capacity C2max to the buffer capacity C2set of the second buffer chamber 81A may be provided, for example, and the pressurizing pump 5A and the decompression pump 7A may be controlled such that the buffer capacity C1 of the first buffer chamber 61A is constantly smaller than the buffer capacity C2 of the second buffer chamber 81A in the period of time from when the operation is started to when the quantitative control period is started based on results of detection of the sensors.

As described above, since the pressure of the ink in the nozzles 126 of the recording head 1 may be negative relative to the atmospheric pressure only by reducing the capacity difference ΔC1 of the first buffer chamber 61A to be smaller than the capacity difference ΔC2 of the second buffer chamber 81A at the time of the circulation and the non-circulation, control on the decompression section 7 and the pressurizing section 5, such as control of causing the decompression section 7 to delay relative to the pressurizing section 5 at a time when the circulation is transferred to the non-circulation, may be eliminated. Therefore, even when the non-circulation state is entered from the circulation state in a state in which the control on the pressurizing section 5 and the decompression section 7 is not performed due to stop of the ink jet recording system at an accidental timing, such as a timing of blackout, leakage of the ink from the nozzles 126 may be suppressed.

Note that the capacity C1 of the first buffer chamber 61A and the capacity C2 of the second buffer chamber 81A may be set only by changing positions of the first sensor 68 and the second sensor 88 when a cross sectional area across a moving direction of the first operation plate 64 of the first buffer chamber 61A and a cross sectional area across a moving direction of the second operation plate 84 of the second buffer chamber 81A are the same, that is, the first buffer chamber 61A and the second buffer chamber 81A have a cylindrical shape and have the same inner diameter, for example.

As described above, the ink jet recording system which is the liquid ejecting system of this embodiment includes the ink jet recording head 1 which is a liquid ejecting head having nozzles 126 ejecting ink which is liquid, the supply channel 3 communicating with the nozzles 126, and the recovery channel 4 communicating with the nozzles 126. Ink is circulated to the ink jet recording head 1 through the supply channel 3 and the recovery channel 4. The supply channel 3 includes the pressurizing section 5 and the first buffer mechanism 6 disposed between the nozzles 126 and the pressurizing section 5. The recovery channel 4 includes the decompression section 7 and the second buffer mechanism 8 disposed between the nozzles 126 and the decompression section 7. The first buffer mechanism 6 is configured to increase a buffer capacity as the supply channel 3 is pressurized. The second buffer mechanism 8 is configured to reduce a buffer capacity as the recovery channel 4 is decompressed.

Since the supply channel 3 includes the first buffer mechanism 6, the first buffer mechanism 6 may reduce a pressure change of pulsation by the pressurizing section 5 or the like and the ink may be supplied to the ink jet recording head 1 with a stable pressure. Furthermore, since the recovery channel 4 includes the second buffer mechanism 8, the second buffer mechanism 8 may reduce a pressure change of pulsation by the decompression section 7 or the like and collect the ink from the ink jet recording head 1 with a stable pressure. Accordingly, the circulation of the ink may be stably performed between the ink tank 2 and the ink jet recording head 1, that is, the circulation may be performed such that the pressure of the ink in the nozzles 126 is constantly negative, and the leakage of the ink from the nozzles 126 may be suppressed. Furthermore, since the first buffer mechanism 6 performs the pressure control, a pressure control valve or the like which is opened when a channel on a downstream of the supply channel 3 has a negative pressure is not required, and therefore, the configuration may be simplified and cost may be reduced. Similarly, since the second buffer mechanism 8 performs the pressure control, a pressure control valve or the like which is opened when a channel on a downstream of the recovery channel 4 has a negative pressure is not required, and therefore, the configuration may be simplified and cost may be reduced.

Furthermore, in the ink jet recording system of this embodiment, the first buffer mechanism 6 and the second buffer mechanism 8 may have mechanisms for detecting the buffer capacity. In this embodiment, the first movable section 66, the first movable section biasing section 67, and the first sensor 68 are provided as the detection mechanism of the first buffer mechanism 6. Furthermore, the second movable section 86, the second movable section biasing section 87, and the second sensor 88 are provided as the detection mechanism of the second buffer mechanism 8. Since the first buffer mechanism 6 and the second buffer mechanism 8 have the respective detection mechanisms detecting the buffer capacity, the first buffer mechanism 6 and the second buffer mechanism 8 may individually detect the buffer capacity. The pressure in the buffer chambers may be controlled by controlling the pressurizing section 5 and the decompression section 7 such that the buffer capacity is controlled based on results of the detection of the buffer capacity.

Furthermore, in the ink jet recording system of this embodiment, at the time of the circulation of the ink which is liquid, the pressurizing section 5 may be controlled based on detection of the buffer capacity of the first buffer mechanism 6 and the decompression section 7 may be controlled based on detection of the buffer capacity of the second buffer mechanism 8. Accordingly, the pressurizing section 5 and the decompression section 7 may be controlled based on pressure in the first buffer chamber 61A and the second buffer chamber 81A based on the buffer capacity, and pressure control may be performed in accordance with the buffer capacity of the first buffer chamber 61A and the buffer capacity of the second buffer chamber 81A.

Furthermore, the pressurizing section 5 and the decompression section 7 may be controlled such that, when the circulation operation is performed, the capacity difference $\Delta C1$ of the buffer capacity of the first buffer mechanism 6 between the circulation state and the non-circulation state is smaller than the capacity difference $\Delta C2$ of the buffer capacity of the second buffer mechanism 8 between the circulation state and the non-circulation state. Accordingly, when the non-circulation state is entered from the circulation state, an amount of supply of the ink from the supply channel 3 to the recording head 1 is smaller than an amount of collection of the ink from the recording head 1 to the recovery channel 4, and therefore, the pressure of the ink in the nozzles 126 of the recording head 1 may be maintained to be negative so that the leakage of the ink from the nozzles 126 is suppressed. Furthermore, the pressurizing section 5 and the decompression section 7 are not required to be controlled to suppress the leakage of the ink from the nozzles 126 when the non-circulation state is entered from the circulation state, and therefore, the leakage of the ink from the nozzle 126 may be suppressed even when an accident occurs, such as blackout.

Moreover, in the ink jet recording system of this embodiment, the first buffer mechanism 6 may include the first buffer chamber 61A, the first flexible wall 63 configured to be operated based on a pressure difference between pressure in the first buffer chamber 61A and external pressure and change the buffer capacity of the first buffer chamber 61A, and the first biasing section 65 configured to bias the first flexible wall 63 in a direction in which the buffer capacity is reduced. Accordingly, since the buffer capacity is maintained constant, pressure of the ink supplied from the first buffer mechanism 6 may be stable.

Furthermore, in the ink jet recording system of this embodiment, the first buffer mechanism 6 may include the first sensor 68 configured to detect a position of the first flexible wall 63 and detect the buffer capacity of the first buffer chamber 61A based on a result of the detection performed by the first sensor 68. Accordingly, the buffer capacity of the first buffer chamber 61A may be easily detected without a complicated configuration.

Furthermore, in the ink jet recording system of this embodiment, the second buffer mechanism 8 may include the second buffer chamber 81A, the second flexible wall 83 configured to be operated based on a pressure difference between pressure in the second buffer chamber 81A and external pressure and change the buffer capacity of the second buffer chamber 81A, and the second biasing section 85 configured to bias the second flexible wall 83 in a direction in which the buffer capacity is increased. Accordingly, ink recovery pressure of the second buffer mechanism 8 may be stable by maintaining the buffer capacity constant.

Furthermore, in the ink jet recording system of this embodiment, the second buffer mechanism 8 may include the second sensor 88 configured to detect a position of the second flexible wall 83 and detect a buffer capacity of the second buffer chamber 81A based on a result of the detection performed by the second sensor 88. Accordingly, the buffer capacity of the second buffer chamber 81A may be easily detected without a complicated configuration.

Other Embodiments

Although an embodiment of the present disclosure has been described hereinabove, a basic configuration of the present disclosure is not limited to that described above.

For example, although the circulation communication path 119 is communicated with the supply communication path 118 used to communicate the pressure generation chamber 112 of the recording head 1 with the nozzles 126 so that the ink in the pressure generation chamber 112 is circulated, the present disclosure is not limited to this and a discharge port for discharging ink to the manifold 100 may be disposed so that the ink in the manifold 100 is circulated. Specifically, the recording head 1 at least has a channel which discharges supplied ink from a portion other than the nozzles 126.

Furthermore, although a thin film piezoelectric actuator is used as the pressure generation section which causes a change in pressure in the pressure generation chamber 112 in the first embodiment described above, the present disclosure is not limited to this, and a thick film piezoelectric actuator formed by a method for attaching a green sheet for example or a vertical vibration piezoelectric actuator which stretches, in an axial direction, piezoelectric members and electrode formation members which are alternately laminated or the like may be used. Moreover, as the pressure generation section, a heater element may be disposed in the pressure generation chamber so that droplets are discharged from nozzles by bubbles generated due to heat of the heater element or a so-called electrostatic actuator may be used which discharge droplets from nozzles after generating static electricity between a vibration plate and an electrode so that the vibration plate is deformed by the static electricity.

Furthermore, the present disclosure is widely made for the entire liquid ejecting system and is applicable to liquid ejecting systems having recording heads, such as various types of ink jet recording heads employed in image recording apparatuses, such as printers, color material ejecting heads used for fabrication of color filters of liquid crystal displays and the like, electrode material ejecting heads used for formation of electrodes of organic EL displays, field emission displays (FEDs), and the like, and bioorganic substance ejecting heads employed for fabrication of biochips.

What is claimed is:

1. A liquid ejecting system comprising:

a liquid ejecting head having a nozzle ejecting liquid;

a supply channel communicating with the nozzle; and a recovery channel communicating with the nozzle, the system circulating the liquid in the liquid ejecting head through the supply channel and the recovery channel, wherein the supply channel includes a pressurizing section and a first buffer mechanism disposed between the nozzle and the pressurizing section, the recovery channel includes a decompression section and a second buffer mechanism disposed between the nozzle and the decompression section, the first buffer mechanism is configured to increase a buffer capacity as the supply channel is pressurized, the second buffer mechanism is configured to reduce a buffer capacity as the recovery channel is decompressed, the first buffer mechanism having a first mechanism for detecting the buffer capacity, the first mechanism being part of the first buffer mechanism; and the second buffer mechanism having a second mechanism for detecting the buffer capacity, the second mechanism being part of the second buffer mechanism.

2. The liquid ejecting system according to claim 1, wherein, when the liquid is circulated, the pressurizing section is controlled based on detection of the buffer capacity of the first buffer mechanism, and the decompression section is controlled based on detection of the buffer capacity of the second buffer mechanism.

3. The liquid ejecting system according to claim 1, wherein the pressurizing section and the decompression section are controlled at a time of a circulation state such that a capacity difference of the buffer capacity of the first buffer mechanism between the circulation state and a non-circulation state is smaller than a capacity difference of the buffer capacity of the second buffer mechanism between the circulation state and the non-circulation state.

4. The liquid ejecting system according to claim 1, wherein the first buffer mechanism includes a first buffer chamber, a first flexible wall configured to be operated by a pressure difference between an inside of the first buffer chamber and an outside and change buffer capacity of the first buffer chamber, and a first biasing section configured to bias the first flexible wall in a direction in which the buffer capacity is reduced.

5. The liquid ejecting system according to claim 4, wherein the first buffer mechanism includes a sensor detecting a position of the first flexible wall, and detects the buffer capacity of the first buffer chamber based on a result of detection performed by the sensor.

6. The liquid ejecting system according to claim 1, wherein the second buffer mechanism includes a second buffer chamber, a second flexible wall configured to be operated by a pressure difference between an inside of the second buffer chamber and an outside and change buffer capacity of the second buffer chamber, and a second biasing section configured to bias the second flexible wall in a direction in which the buffer capacity is increased.

7. The liquid ejecting system according to claim 6, wherein the second buffer mechanism includes a sensor detecting a position of the second flexible wall, and detects the buffer capacity of the second buffer chamber based on a result of detection performed by the sensor.

* * * * *